US006598579B2

(12) United States Patent
Goodenough et al.

(10) Patent No.: US 6,598,579 B2
(45) Date of Patent: Jul. 29, 2003

(54) FUEL INJECTION PUMP FOR AN INTERNAL COMBUSTION ENGINE

(75) Inventors: Scott Goodenough, Kalamazoo, MI (US); Thomas Stegink, Kalamazoo, MI (US); Brent Brower, Byron Center, MI (US); Thomas Rapp, Besigheim (DE)

(73) Assignee: Diesel Technology Company, Kentwood, MI (US)

( * ) Notice: Subject to any disclaimer, the term of this patent is extended or adjusted under 35 U.S.C. 154(b) by 0 days.

(21) Appl. No.: 09/756,369

(22) Filed: Jan. 8, 2001

(65) Prior Publication Data

US 2002/0088434 A1 Jul. 11, 2002

(51) Int. Cl.[7] ..... F02M 37/04
(52) U.S. Cl. ..... 123/198 D; 123/514
(58) Field of Search ..... 123/495, 506, 123/446, 198 D, 514, 456; 417/423.11

(56) References Cited

U.S. PATENT DOCUMENTS 6,019,091 A 2/2000 Spoolstra
6,112,727 A * 9/2000 Cristiani et al. ..... 123/514

* cited by examiner

*Primary Examiner*—Carl S. Miller
(74) *Attorney, Agent, or Firm*—Brooks & Kushman P.C.

(57) ABSTRACT

A fuel injector pump in a direct-injection fuel delivery system for an internal combustion engine including a solenoid valve for controlling the transfer of fluid from the high pressure chamber of the camshaft driven pump pressure chamber to a fuel injector nozzle. A supply passage accommodates fuel delivery and return for fuel supplied by a fuel pump. A second independent leak flow path is provided to accommodate fuel leaking past a plunger of the high pressure pump, the fuel leak path extending to the fuel supply rather than leaking past the high pressure plunger of the pump to the engine lubrication oil circuit.

7 Claims, 6 Drawing Sheets

FUEL INJECTION PUMP FOR AN INTERNAL COMBUSTION ENGINE

TECHNICAL FIELD

The invention relates to a liquid fuel injection system for a direct-injection engine.

BACKGROUND ART

A fuel delivery system for an internal combustion engine operating with a diesel cycle includes an engine-driven fuel injection pump with a plunger that reciprocates in a plunger cylinder to effect fuel delivery to each of the working cylinders of the engine. The pump stroke frequency is directly proportional to engine speed. A fuel control valve under the control of an electromagnetic solenoid actuator establishes controlled fuel delivery from the pump to fuel injection nozzles. In the case of a direct injection compression ignition engine, a fuel injection nozzle would be located in the combustion chamber of each of the engine cylinders. The solenoid actuator for the valve is responsive to controlled current pulses in the driver circuit of a digital electronic engine controller, whereby fuel is metered from the injector pump to the nozzles as the pump creates the necessary pressure pulses.

The plunger typically is driven by the engine camshaft, which operates the intake and exhaust valves of the engine. It is located in the cylinder head for the engine where it is exposed to engine lubrication oil. Any fuel that leaks past the clearance between the plunger and the plunger cylinder tends to commingle with the engine lubrication oil, thereby creating a dilution problem after an extended operating period.

It is possible to reduce leakage past the plunger by reducing the dimensional clearance between the plunger and the plunger cylinder. A reduction in the dimensional tolerance, however, increases the risk of pump seizure. Greater mechanical friction losses and increased wear, particularly in those applications in which the fuel temperature varies throughout a relatively wide temperature range, also may result from reduced clearance. Further, the machining required for a close tolerance fit between the plunger and the cylinder would increase manufacturing costs, which would make the pump and fuel supply system impractical for high volume manufacturing operations.

It also may be possible to reduce oil dilution due to fuel leakage past the plunger by increasing the length of the plunger, thereby increasing the leak flow path length from the high pressure pumping chamber to the engine camshaft cavity. This would result, however, in only a moderate decrease in leakage and would require a significant increase in the overall dimensions of the pump and control valve assembly. This would make it impractical for some commercial engine applications because of packaging constraints.

Examples of prior art pump and control valve assemblies for diesel engines of the kind that are commercially available may be seen by referring to U.S. Pat. No. 6,019,091. Further, copending application Ser. No. 09/272,021, filed Mar. 18, 1999, discloses a fuel pump and control valve assembly with elements corresponding to elements included in the present invention. The '091 patent and the copending patent application are assigned to the assignee of the present invention.

DISCLOSURE OF INVENTION

It is an objective of the invention to reduce engine oil dilution with engine fuel by decreasing the leakage of fuel past the injection pump plunger into the lubrication oil circuit of the engine. In carrying out that objective, the pump and fuel control valve assembly of the invention comprises a fuel pump body with a pump cylinder for receiving a reciprocating pump plunger. A pump plunger spring normally urges the plunger to a retracted position. The plunger is driven during its working stroke by the engine camshaft, which is driven at one-half engine crankshaft speed.

The plunger and the cylinder define a high pressure working chamber that communicates with an injection nozzle through a high pressure fuel delivery passage, which is intersected by a pump flow control valve. Fuel is supplied to the control valve and to the working chamber of the pump from a fuel supply pump. The control valve opens and closes the fuel flow through the high pressure fuel delivery passage in accordance with commands transmitted to a solenoid actuator by an engine controller module. The valve is opened and closed in timed relationship with respect to the stroking of the plunger so that an initial pilot pulse is delivered by the nozzle to the engine combustion chamber. This is followed, in turn, by a main fuel delivery pressure pulse at the outset of the compression stroke of the engine cylinder.

The pump and control valve assembly of the invention comprises a pump housing or body with a pumping chamber defined by a cylinder in a cylinder body. A plunger is situated in the cylinder to define a high pressure fuel pump cavity, which communicates with the fuel injector nozzle. In one embodiment of the invention, the plunger and the cylinder are located in a common valve body or housing. In another embodiment of the invention, the cylinder is situated in a first pump housing, and the control valve assembly is situated in a separate valve housing, the two housings being joined by a housing portion in which are situated crossover fuel flow passages. In each instance, a single supply and return fuel passage extends to the pump and control valve assembly from a fuel pump. For this reason, the design commonly is referred to as a monorail design. Flow passages for the fuel to and from the fuel supply pump are not defined by separate supply and return passages as in a dual rail arrangement.

The pump plunger displaces fuel in the pump cavity as fuel is delivered by the high pressure fuel delivery passage to the injector nozzle.

At least one low pressure leak-off passage communicates with one or more fuel leak ports formed in the pump housing. A leak flow path in the passage defined by a predetermined clearance between the plunger and the plunger cylinder communicates with the low pressure leak-off passage, whereby fuel flow that leaks past the plunger is returned to the fuel reservoir for the fuel supply pump rather than flowing to the region of the camshaft in the engine housing. The pump plunger, when it is moved to a retracted position, covers the leak ports. Thus, the fuel circuit is independent of the lubrication oil for the engine so that oil dilution is eliminated or substantially reduced. This characteristic increases the durability of the fuel injection pump and control valve assembly and reduces maintenance costs for the engine.

In a typical operating environment for the engine, the fuel supply and return passage may be pressurized at a value of about 5 bar, whereas the low pressure leak-off passage that communicates with the fuel reservoir for the fuel supply pump may be at a substantially lower value, such as 1 bar. This pressure differential makes it possible for a leakage flow path through the clearance between the plunger and the cylinder to be diverted to the low pressure leak-off passage rather than to the camshaft region of the engine.

BEST MODE FOR CARRYING OUT THE INVENTION

Figure 1:
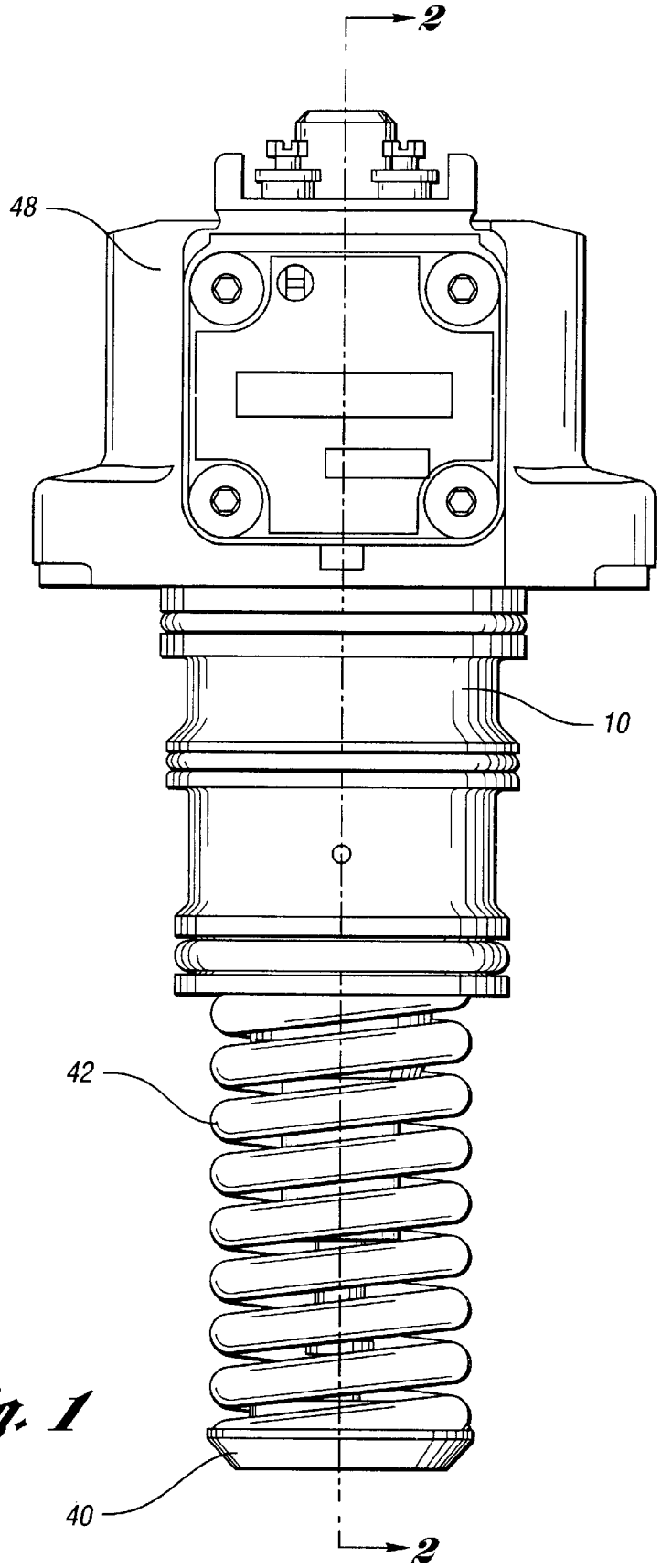
FIG. 1 is a side elevation view of the pump and control valve assembly of the invention.

Numeral 10 designates a pump housing or body for a fuel injector and control valve assembly. The housing comprises a cylinder 12 in which is positioned a plunger 14. The cylinder 12 and the plunger 14 define a pressure cavity 16, which communicates through high pressure passage 18 with control valve chamber 20. The chamber 20 intersects passage 18. A threaded fitting element 23, located at the upper end of the housing 10, accommodates a hydraulic connection between a fuel injection nozzle (not shown) positioned in a combustion chamber for the engine. A hollow valve element 22 is mounted in the valve chamber 20. The left end of the valve element 22 is engageable with a stop 24, which is secured in a stop opening 26 in the housing 10. The stop is secured in place by a retainer plate 28.

An annular space between opening 26 and stop 24 is shown at 30. It communicates with an internal passage 32 in the housing 10. Passage 32 communicates with a supply-and-return passage schematically shown at 34.

Passage 34 communicates with passage 32 through an annular groove 36 formed on the exterior surface of the housing 10. The passage 34 is sealed by O-ring seals as shown.

The housing 10 is received in a sleeve 37 surrounding the housing 10. The sleeve 37 may form a part of, or may be connected to, the engine housing that defines the engine cylinders.

Figure 2:
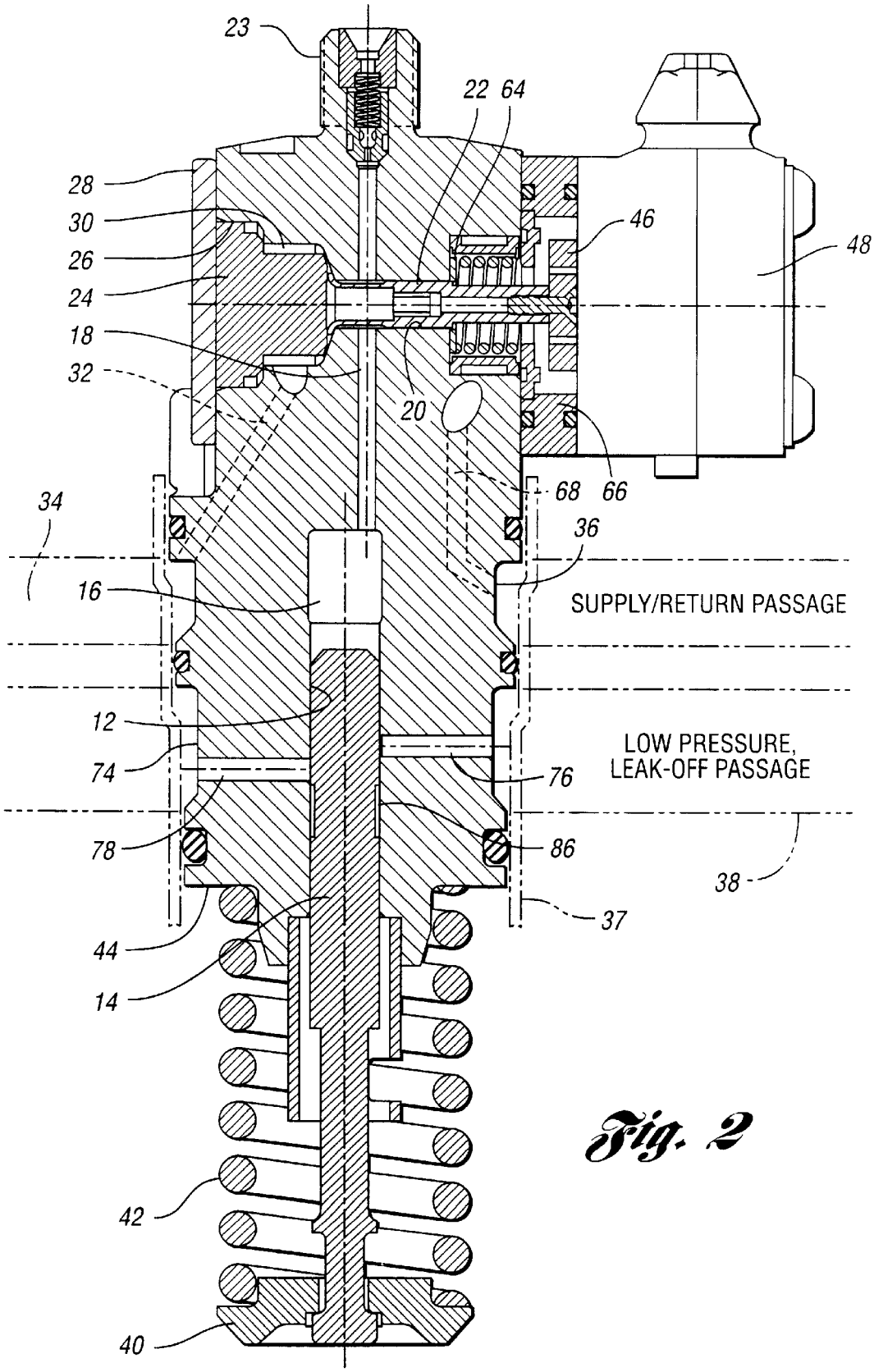
FIG. 2 is a cross-sectional view taken along the plane of section line 2—2 of FIG. 1.

Plunger 14 extends downwardly, as viewed in FIG. 2, and carries a spring seat 40. A camshaft, not shown in FIG. 2, carries a cam that engages a roller follower arm, not shown, which engages the lower end of the plunger 14 and drives the plunger 14 within the cylinder 12 against the force of valve spring 42. The upper end of valve spring 42 is seated on a shoulder formed on the housing 10, as shown at 44.

The right-hand end of the hollow valve element 22 is secured to an armature 46. The armature is actuated in the direction of the axis of the valve element 22 by a solenoid actuator 48.

Figure 4:
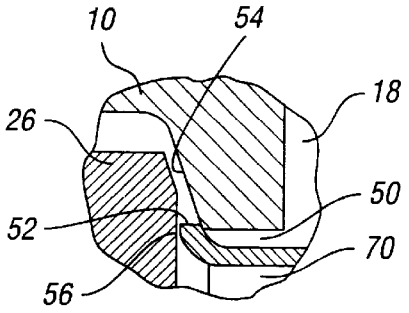
FIG. 4 is a partial detail view of the opposite end of the control valve, as seen in FIG. 3.
Figure 5:
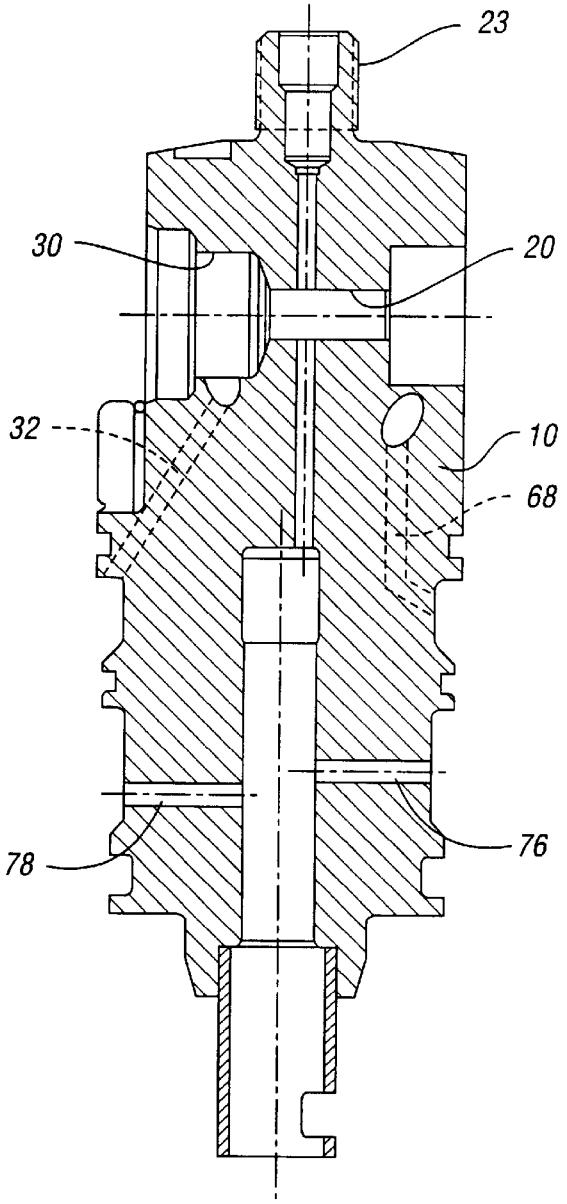
FIG. 5 is a detail sectional view of the housing portion for the pump cylinder, as seen in FIG. 2.
Figure 6:
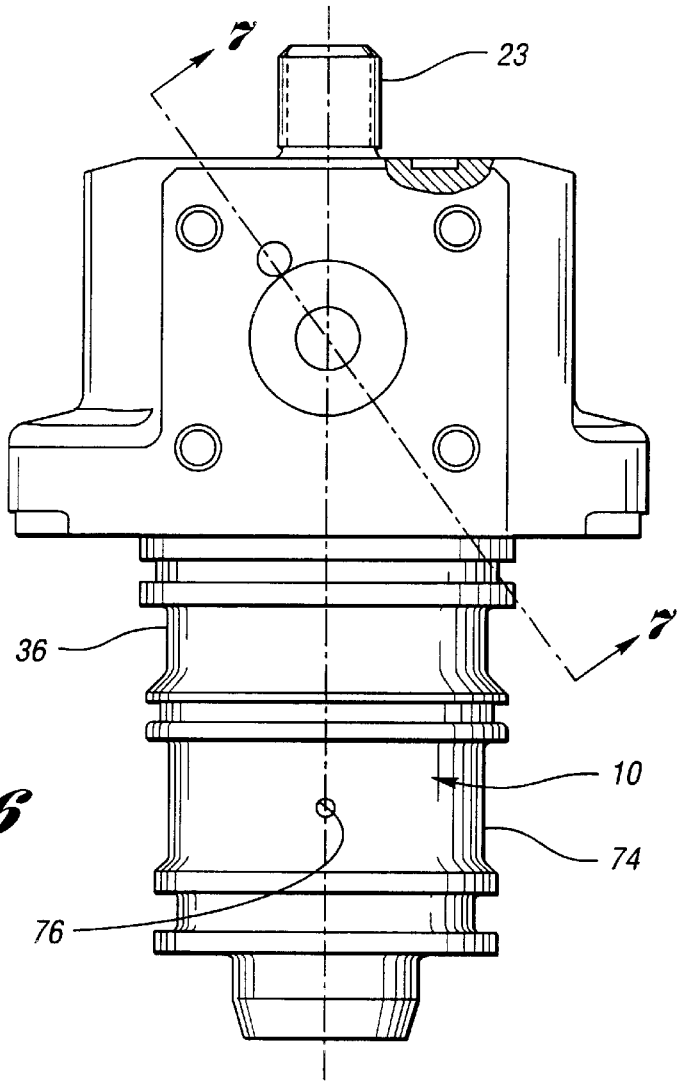
FIG. 6 is an enlarged elevation side view of the cylinder housing shown in FIG. 2.

The left-hand end of the valve element 22 is seen in the enlarged detail view of FIG. 4. Valve element 22 comprises an annular groove 50, which extends to the left end of the valve element 22, as shown at 52. The valve end 52 engages valve seat 54 surrounding the valve element. Seat 54 is defined by the valve housing 10.

When the valve end 52 is seated on the valve seat 54, a space is established between the left end of the valve element 22 and the stop 26. The space is designated by reference numeral 56.

Figure 3:
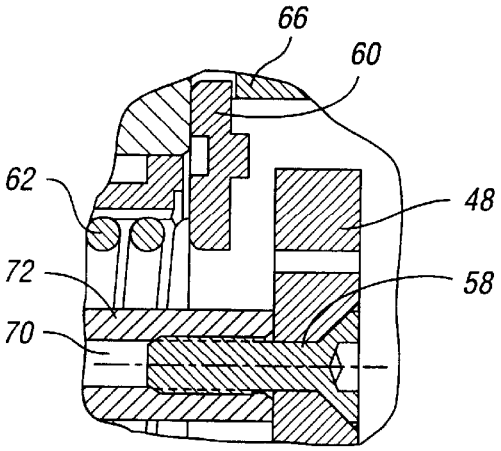
FIG. 3 is a detail view of one end of the control valve assembly for the pump and control valve assembly of FIG. 1.

FIG. 3 is an enlarged detail view of the right end of the valve element 22. It is secured to the armature by a suitable attachment element such as screw 58. A spring seat, seen in FIG. 3 at 60, is engaged by valve spring 62, which in turn is seated on a valve seat 64, seen in FIG. 2. The valve seat is anchored on an annular shoulder formed on the hollow valve element 22 so that the valve element 22 normally is shifted in a left-hand direction against the stop 26. When the stop 26 is engaged by the valve element 22, an annular space is established between the valve end 52 and the annular valve seat 54, as seen in FIG. 4.

The seat 60 is secured in place by a retainer ring seen in FIGS. 2 and 3 at 66.

When the solenoid 48 is energized, the armature 46 is shifted in a right-hand direction, thereby shifting the valve element 22 to the closed position as communication between the supply passage 34 and the pressure chamber 16 is interrupted. Concurrently, the groove 50 maintains communication between the pressure chamber 16 and the high pressure passage 18 leading to the injector nozzle.

Figure 7:
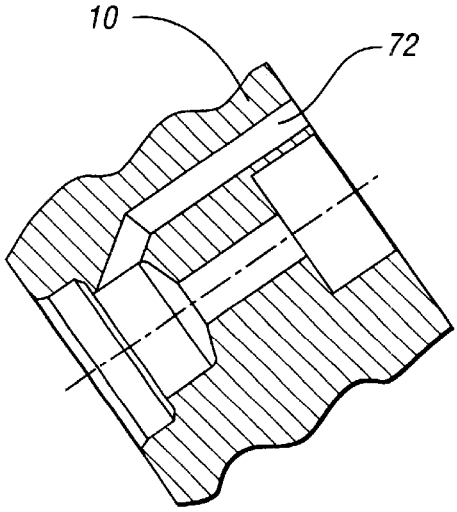
FIG. 7 is a cross-sectional view taken along the plane of section line 7—7 of FIG. 6 showing an internal crossover passage.

A secondary fuel supply passage 68 establishes communication between the supply passage 34 and the interior of the valve element 22, which is seen in FIGS. 3 and 4 at 70. That communication between the valve element interior 70 and the secondary passage 68 is established by internal porting formed in the housing 10. This porting is partially shown in the cross-sectional view of FIG. 7 at 72.

When the plunger is driven in an upward direction, as viewed in FIG. 2, the controller will energize the solenoid so that the valve element 22 will seat against the valve seat 54. When the plunger strokes in the opposite direction, the solenoid actuator 48 is commanded by the controller to shift the valve element 22 to the left, thereby allowing fuel to flow through passage 34, passage 32, the space 30 surrounding the stop 24, and through the annular space between the valve end 52 and the valve seat 54. This allows the cavity 16 to fill. Fuel is simultaneously supplied through passage 68 and through the interior of valve element 22 to the passage 18, and then to the cavity 16.

Low pressure leak-off passage 38 communicates with an annular groove 74 in the housing 10, as seen in FIG. 2. Groove 74 communicates with fuel leak-off ports 76 and 78, which communicate with the clearance space between the plunger 14 and the wall of the cylinder 12.

Fuel that leaks past the plunger 14 during the compression stroke of the plunger will pass through the clearance space to the low pressure ports 76 and 78. The leakage then returns to the fuel supply reservoir. The plunger 14 may be provided with an annular space or annulus 83, as seen in FIG. 2. When the plunger 14 assumes the retracted position shown in FIG. 2, the annulus 83 is below the ports 78 and 76. When the plunger 14 is stroked during fuel delivery, the annulus 83 communicates with the ports 78 and 76, thereby encouraging the leakage fluid to pass into the low pressure leak-off passage 38 rather than continuing its leakage passage to the camshaft chamber of the engine.

Figure 8:
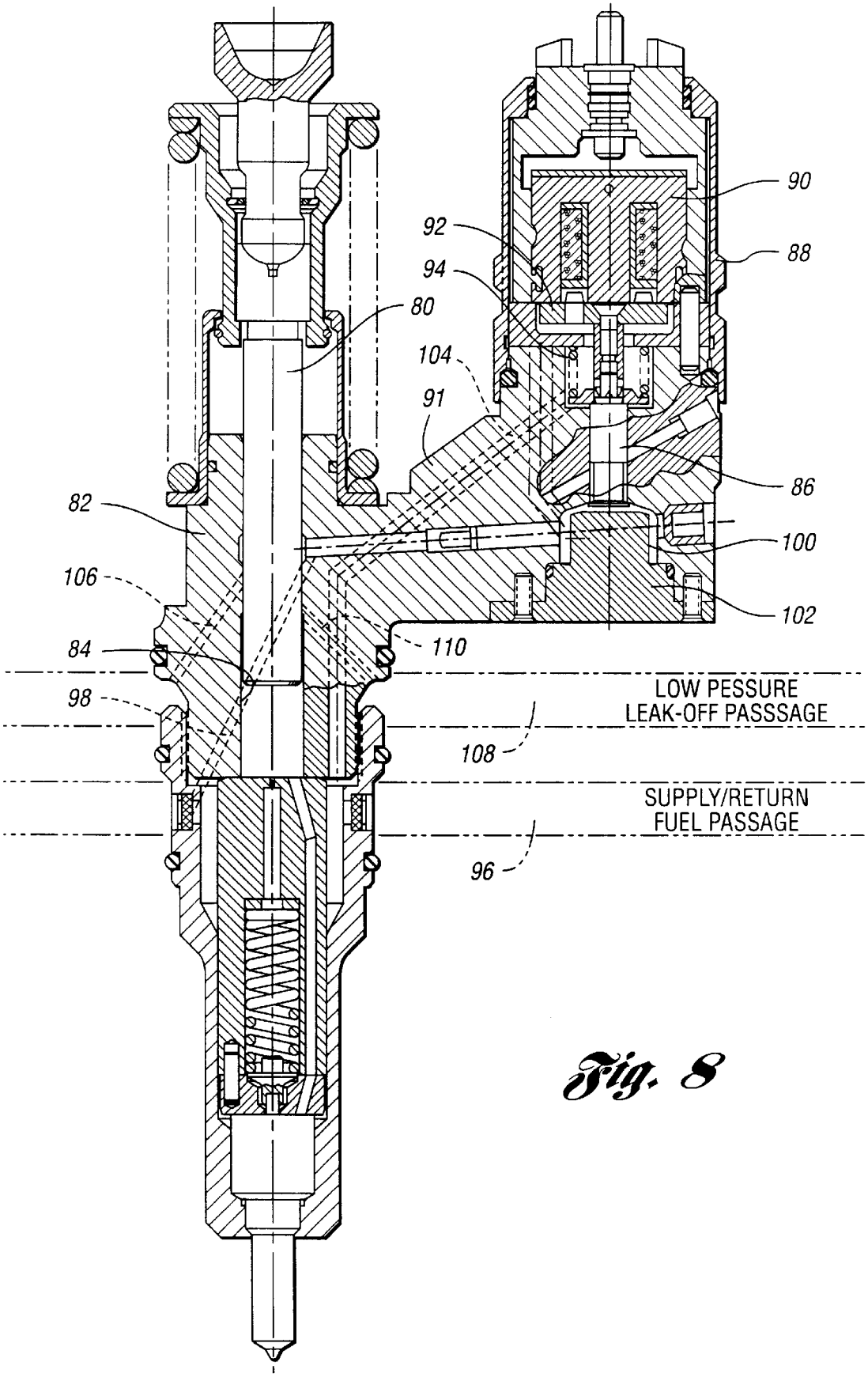
FIG. 8 is a cross-sectional view of a cylinder and plunger assembly and a control valve assembly for an alternate embodiment of the invention.

The embodiment of FIG. 8 functions in a manner similar to that of the embodiment of FIG. 2. The embodiment of FIG. 8 includes a plunger 80 that reciprocates with a pump housing 82. Control valve element 86 has a cylinder portion in the housing 82. The cylinder portion has a close clearance with respect to the plunger 80. Control valve element 86 is located in a valve housing 88 that is separate from the cylinder housing 82, but the housings are connected as shown at 91. The solenoid actuator 90, when energized, moves an armature 92, which is connected to valve element 86. The force of the armature shifts the valve element against the force of valve spring 94.

Fuel is supplied through the supply-and-return fuel passage 96, which communicates through internal passage structure 98 with annular space 100 surrounding stop 102. Stop 102, as in the case of the stop of the embodiment of FIG. 2, is engaged by movable valve element 86 when the solenoid actuator 90 is de-energized.

Fuel is supplied also from passage 96 to the interior of the valve element 86 through internal passage structure 104.

A fuel leak-off port 106 extends from the clearance space between the plunger 80 and the cylinder 84 to the low pressure leak-off passage 108. Similarly, a leak-off port extends between the annular space between the plunger 80 and the cylinder 84 to the leak-off passage 108 as seen at 110.

The embodiment of FIG. 8, like the embodiment of FIG. 2, is a single rail design wherein fuel is supplied to the cylinder pressure chamber or cavity and is returned to the fuel pump through a single passage shown at 96. This is unlike the dual-rail design described, for example, in the '091 patent previously discussed.

In each of the embodiments described with reference to FIGS. 2 and 8, the decreased fuel leakage reduces the tendency of the oil to become diluted.

Figure 9:
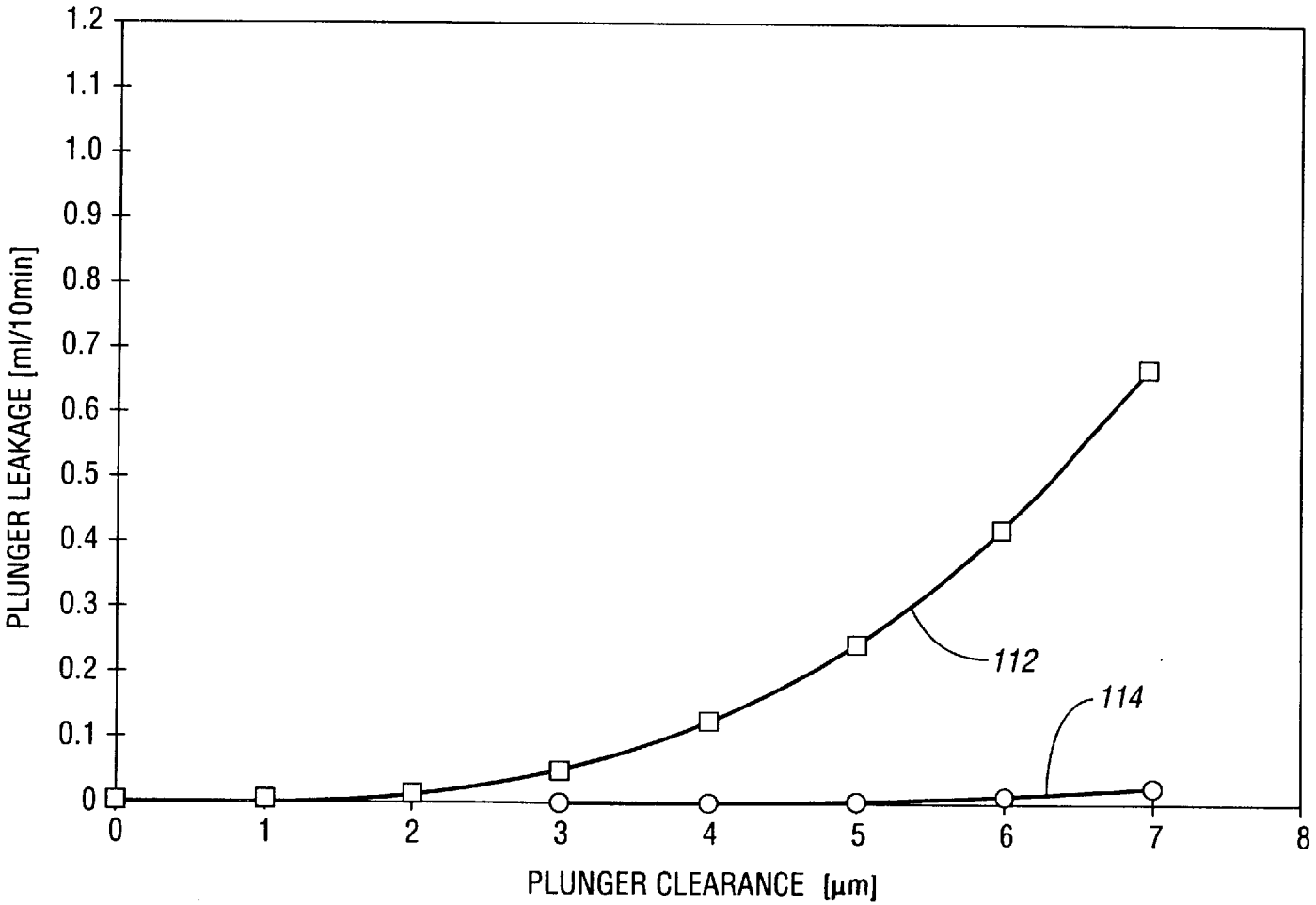
FIG. 9 is a chart showing the relationship between plunger leakage and plunger clearance in an oil dilution study.

FIG. 9 shows a test plot of the relationship between plunger clearance and plunger leakage for a working embodiment of the invention. The leakage for a conventional dual rail design is shown at 112. The maximum leakage for the maximum clearance indicated in FIG. 9 for the conventional dual rail design is about 0.65 ml measured over a period of 10 minutes. This is significantly reduced by employing the monorail fuel passage design of FIGS. 2 and 8, where the leakage flow is interrupted by the leak ports which communicate directly with the pressure-less or low pressure leak-off passage. The leakage for the design of the invention is shown at 114.

Although embodiments of the invention have been disclosed, it will be apparent to a person skilled in the art that modifications may be made without departing from the scope of the invention. Such modifications and equivalents thereof are intended to be covered by the following claims.

What is claimed is:

1. A fuel injection pump assembly for an internal combustion engine comprising a pump body defining a cylindrical fuel pumping cavity, a pump plunger mounted for reciprocation in the pumping cavity, and a high pressure fuel delivery passage extending from the pumping cavity to an injector nozzle;

a pump control valve in the fuel delivery passage, an actuator for the pump control valve for establishing and interrupting delivery of fuel from the pumping cavity to the injector nozzle;

a cam mechanism driven by the engine including a cam derivably connected to the pump plunger whereby the cam mechanism strokes the pump plunger to effect high pressure fuel delivery to the injector nozzle, the cam mechanism being in communication with lubrication oil in the engine;

a low pressure leak-off passage in the pump body;

a common fuel supply and fuel return passage in the pump body at a location intermediate the low pressure leak-off passage and the high pressure fuel delivery passage;

the common fuel passage communicating with the pump control valve whereby fuel in the fuel delivery passage is distributed to the common passage when fuel delivery to the injector nozzle is interrupted as the pump control valve is opened;

at least one fuel leak-off port in the pump body communicating with the pumping cavity and extending to the low pressure leak-off passage;

the pump plunger, when it is moved to a retracted position, covering the leak-off port;

the pump plunger displacing fuel in the pumping cavity as fuel is delivered by the high pressure fuel delivery passage to the injector nozzle; and a predetermined dimensional clearance between the pump plunger and the pumping cavity defining a leak-off flow path leading to the leak-off port as the pump plunger is advanced in a pumping stroke by the cam mechanism, thereby avoiding mixing of fuel with engine lubrication oil.

2. The fuel injection pump assembly set forth in claim 1 wherein the actuator for the control valve comprises a solenoid operated valve and an electronic controller responsive to engine operating variables for establishing fuel flow from the pumping cavity through the valve and the high pressure fuel delivery passage when the valve is moved by the actuator to a closed position and establishing fuel delivery from the fuel delivery passage through the valve to the pumping cavity when the valve is moved to an open position.

3. The fuel injection pump assembly set forth in claim 1 wherein the leak-off flow path is defined in part by an annular flow path created by the dimensional clearance at one end of the pump plunger.

4. The fuel injection pump assembly set forth in claim 2 wherein the leak-off flow path is defined in part by an annular flow path created by the dimensional clearance at one end of the pump plunger.

5. The fuel injection pump assembly set forth in claim 1 wherein the leak-off passage is defined in part by an annulus formed in the pump plunger, the annulus communicating with the fuel leak-off port as the pump plungers is stroked by the cam mechanism whereby fuel leakage around the pump plunger escapes through the leak-off port.

6. The fuel injection pump assembly set forth in claim 2 wherein the leak-off passage is defined in part by an annulus formed in the pump plunger, the annulus communicating with the fuel leak-off port as the pump plungers is stroked by the cam mechanism whereby fuel leakage around the pump plunger escapes through the leak-off port.

7. The fuel injection pump assembly set forth in claim 3 wherein the leak-off passage is defined in part by an annulus formed in the pump plunger, the annulus communicating with the fuel leak-off port as the pump plungers is stroked by the cam mechanism whereby fuel leakage around the pump plunger escapes through the leak-off port.

* * * * *